US005791276A

United States Patent [19]

Floyd

[11] Patent Number: 5,791,276

[45] Date of Patent: Aug. 11, 1998

[54] SKI RIDER CONTROLS

[76] Inventor: Darrell W. Floyd, 6702 S. 128th W. Ave., Sapulpa, Okla. 74066

[21] Appl. No.: 953,300

[22] Filed: Oct. 17, 1997

[51] Int. Cl.[6] ..... B63H 25/00

[52] U.S. Cl. ..... 114/144 R; 440/87; 441/69; 114/253

[58] Field of Search ..... 114/144 R, 253, 114/144 A, 270; 441/65, 68, 69; 440/38, 84, 87

[56] References Cited

U.S. PATENT DOCUMENTS

| | | | |
|---|---|---|---|
| 2,776,443 | 1/1957 | Howard | 9/18 |
| 2,914,018 | 11/1959 | Schachner et al. | 440/85 |
| 3,145,030 | 8/1964 | Millis | 280/16 |
| 3,156,935 | 11/1964 | Long | 9/310 |
| 3,324,822 | 6/1967 | Carter III | 440/85 |
| 3,828,717 | 8/1974 | Nichols et al. | 115/6.1 |
| 4,034,696 | 7/1977 | Kureth | 115/12 R |
| 4,138,963 | 2/1979 | Thompson | 115/12 R |
| 5,041,040 | 8/1991 | Jones et al. | 114/253 |
| 5,056,450 | 10/1991 | Mardikian | 114/144 R |
| 5,076,189 | 12/1991 | Jones | 114/253 |

*Primary Examiner*—Stephen Avila
*Attorney, Agent, or Firm*—Molly D. McKay

[57] ABSTRACT

Ski rider controls to control throttle and steering of a ski rider. The ski rider controls are flexibly and adjustably secured to the ski rider. The operator may grip the ski rider controls in his two hands, squeezing with one hand to turn the ski rider in one direction and squeezing with the other hand to turn the ski rider in the opposite direction. A thumb-operative thumb throttle is provided on the ski rider controls in order to control acceleration of the ski rider.

9 Claims, 3 Drawing Sheets

SKI RIDER CONTROLS

BACKGROUND OF THE INVENTION

1. Field of the Invention The present invention relates to hand held controls for use in steering and powering a ski rider or similar water craft.

2. Description of the Related Art

Americans now enjoy more leisure time than they have since the country was founded. One recreation which has become popular to fill up part of this leisure time is operating ski riders. Ski riders are one person, self-propelled water craft on which the operator may ride in a seated position or may ride in an upright standing position. When the operator rides a ski rider in an upright standing position, the operator experiences a ride similar to that of a person water skiing behind a motor boat.

Regardless of whether the operator chooses to ride the ski rider sitting down or standing up, the operator must be able to steer the ski rider and must be able to control the speed of the ski rider.

The present invention is a new type of controls which can safely be used by the ski rider in either a sitting or standing position on the ski rider.

One object of the present invention is to provide controls for a ski rider that are quickly adjustable for various heights of operators.

Another object of the present invention is to provide controls for a ski rider that are operable by the operator by using one or both hands.

Still a further object of the present invention is to provide controls which will not injure the operator nor damage the ski rider should the operator drop the controls or fall off the ski rider.

A further object of the present invention is to provide a simple means for steering a ski rider and to provide controls that will kill the motor on the ski rider if the operator releases the controls, either by dropping the controls or by accidentally falling off the ski rider.

SUMMARY OF THE INVENTION

The present invention is ski rider controls for use on a ski rider. The ski rider controls flexibly secure to the ski rider by means of two ropes. Each rope is adjustably secured via one end of each rope to a separate rope securing extension provided inside an external casing of the ski rider controls and secured via an opposite end of each rope to front openings provided in forward extending legs of the ski rider. The rear end of the external casing is provided with first and second rope openings therethrough for the ropes to pass through.

The external casing is also provided with a pair of openings on the top side of the ski rider controls at a front end thereof in order to provide access to a pair of movable bars provided therein. A pair of external bars are provided on the front end of the ski rider controls so that palms of the operator's hands can be placed one on each external bar and the fingers of the operator's hands can extend through the pair of openings to curl around the movable bars. Each movable bar is provided with finger grips for this purpose.

A thumb throttle is provided movably secured to a bottom side of the external casing adjacent the front end so that thumbs of the operator's hands can movably engage thumb indentations provided in the thumb throttle in order to pivot the thumb throttle relative to the external casing. A throttle cable secures to the thumb throttle on one end of the throttle cable, passes through a throttle cable bracket provided secured to the inside of the external casing, exits the ski rider controls via the first rope opening, enters the ski rider via the front opening in one of the legs of the ski rider and operatively secures to a motor that powers the ski rider in order to provide throttle controls over the motor.

Each of the movable bars is provided with a companion bar that is spaced apart from and rearward of its associated movable bar and is, along with its associated movable bar, movably retained between a pair of tracks provided within the external casing. Each of the two pairs of tracks extends from its respective external bar on the front end of the ski rider controls rearward toward the rear end thereof so that the movable bars, along with their associated companion bars, can be moved forward or rearward within their associated tracks in the ski rider controls.

Each of the companion bars is secured via an arm to an opposite end of a pivotable bar. The pivotable bar is located within the external casing and rearward of the tracks. The pivotable bar pivotably secures to the inside of the external casing at a pivot point.

A control cable secures by one end of the control cable to one end of the pivotable bar, passes through a control cable bracket provided secured to the inside of the external casing, passes through the first rope opening along with the first rope and the throttle cable, enters the ski rider via a front opening in one of the legs of the ski rider and operatively secures to a movable water jet that steers the ski rider in order to provide steering control over the ski rider.

DETAILED DESCRIPTION OF THE PREFERRED EMBODIMENT INVENTION

Figure 1:
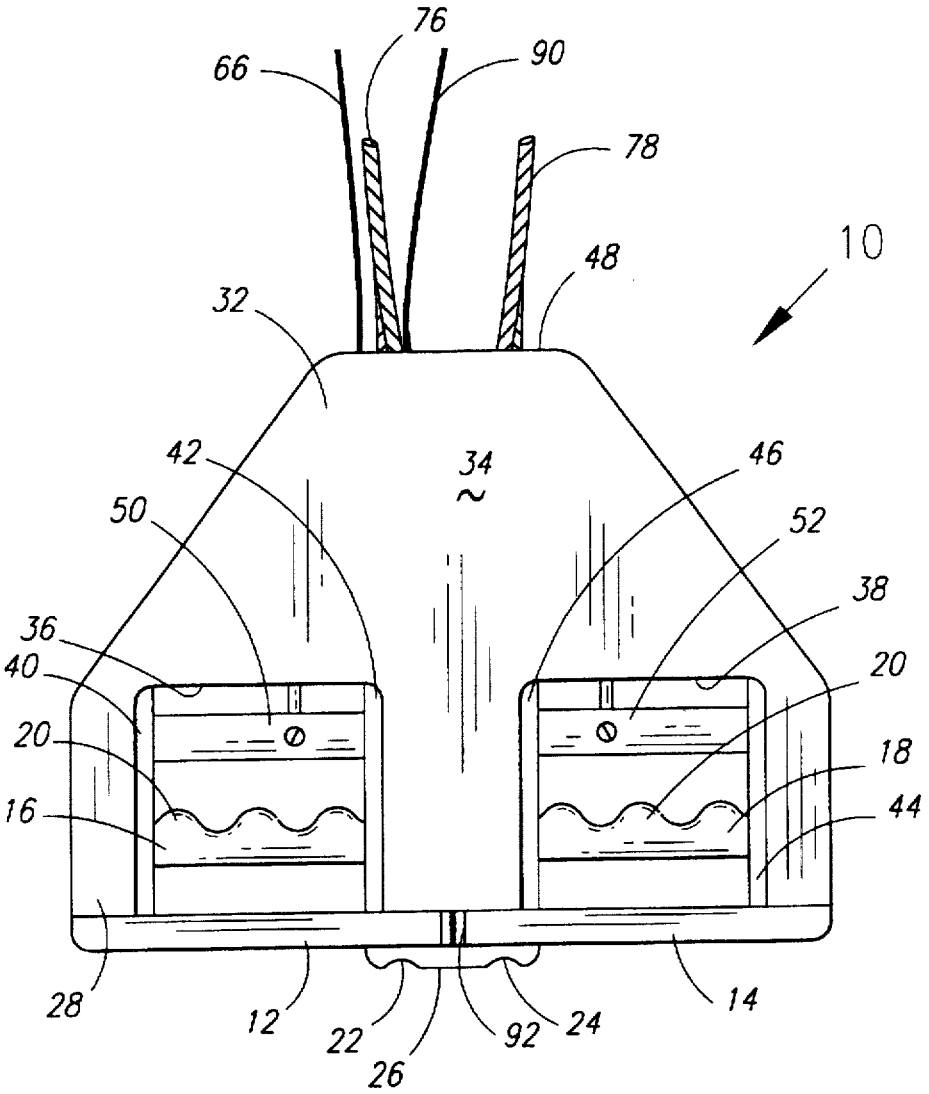
FIG. 1 is a top plan view of the ski rider controls constructed in accordance with a preferred embodiment of the present invention.

Referring now to the drawings and initially to FIG. 1, there is illustrated ski rider controls 10 constructed in accordance with a preferred embodiment of the present invention.

Figure 3:
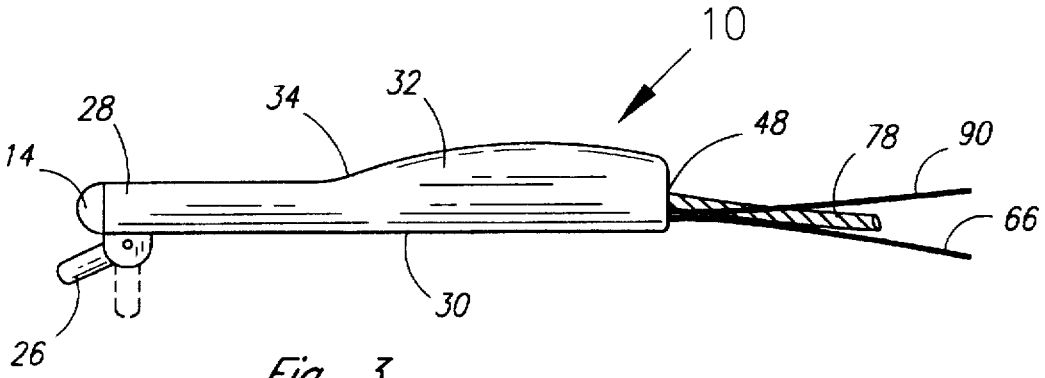
FIG. 3 is a right side elevation of the ski rider controls of FIG. 1.

In order to use the ski rider controls 10, an operator (not illustrated) would place a palm of each of the operators'hands on, respectively, external bars 12 and 14 provided at a front end 28 of the ski rider controls 10. Fingers of each of the operator's hands would curl around, respectively, movable bars 16 and 18, also provided on the ski rider controls 10. Movable bars 16 and 18 are each provided with finger grips 20 to ensure that the operator's fingers do not slip thereon. Thumbs of each of the operator's hand would be placed, respectively, in thumb indentations 22 and 24 provided on thumb throttle 26. The thumb throttle 26 is provided adjacent the front end 28 of the ski rider controls 10 and pivotally secured to a bottom side 30 of ski rider controls 10, as illustrated in FIG. 3.

The ski rider controls 10 are provided with an external casing 32 which serves to protect the ski rider controls 10 from damage and provides smooth edges to protect the operator from being injured by the ski rider controls 10. As shown in FIG. 1, a top side 34 of the ski rider controls 10 is provided with two openings 36 and 38 in the external casing 32. The openings 36 and 38 allow the operator to access, as previously described, the movable bars 16 and 18 located within the external casing 32 by inserting the operators hands through openings 36 and 38.

Figure 4:
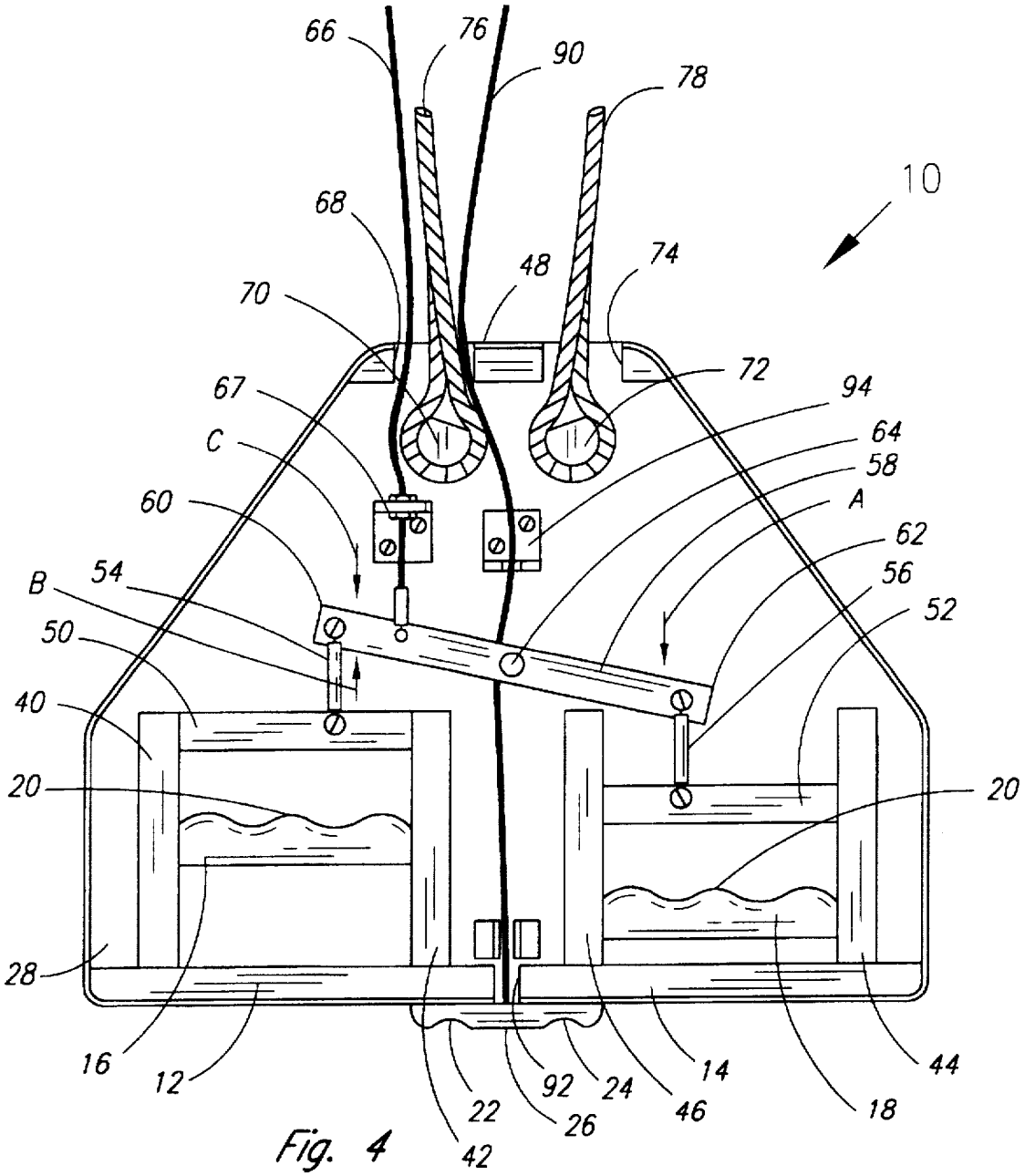
FIG. 4 is a top plan view of the ski rider controls of FIG. 1, shown with its top cover removed.

Referring now to FIG. 4, the internal structure of the ski rider controls 10 is illustrated. Each movable bar 16 and 18 is provided with a pair of parallel tracks, 40 and 42 and 44 and 46 respectively, within which each of the movable bars 16 and 18 travels.

Each pair of tracks, 40 and 42 and 44 and 46, extend from its associated external bar 12 and 14 on one end of the tracks 40, 42, 44, and 46 toward a rear end 48 of the ski rider controls 10 on an opposite end of the tracks 40, 42, 44 and 46. Each of the movable bars 16 and 18 is provided with a companion bar 50 and 52 that is secured to its respective movable bar 16 or 18 and travels along with its movable bar within the associated tracks, either 40 and 42 or 44 and 46. Each companion bar 50 and 52 is provided rearward of its associated movable bar 16 or 18 within the pair of tracks 40 and 42 or 44 and 46 and is spaced apart therefrom a sufficient distance to allow the operator to insert his fingers around the movable bars 16 and 18, as previously described.

Each of the companion bars 50 and 52 is attached by means of an arm, 54 and 56, to a pivotable bar 58 so that the first arm 54 movably secures to a first end 60 of the pivotable bar 58 and the second arm 56 movably secures to an opposite second end 62 of the pivotable bar 58. The pivotable bar 58 is provided centrally with a pivot point 64 where the pivotable bar 58 pivotably secures to the external casing 32.

As illustrated in FIG. 4, when the operator pulls movable bar 18 toward external bar 14, companion bar 52 also moves toward the front end 28 and pulls the second end 62 of the pivotable bar 58 in the direction of Arrow "A". Movement of the second end 62 in the direction of Arrow "A" causes the pivotable bar 58 to pivot at pivot point 64, thus moving the first end 60 in the direction of Arrow "B". As the first end 60 moves in the direction of Arrow "B", it pulls the movable bar 16 and its companion bar 50 rearward and exerts a pushing force on a control cable 66 secured to the pivotable bar 58 adjacent the first end 60. Also, this same sequence of movements which result in a pushing force on the control cable 66 can be initiated by the operator pushing the movable bar 16 away from the external bar 12, for example when the operator is holding the ski rider controls 10 only with the operator's left hand.

Likewise, when the operator either pulls movable bar 16 toward external bar 12, or alternately, pushes movable bar 18 away from external bar 14, the first end 60 of the pivotable bar 58 will move in the direction of Arrow "C", thus exerting a pulling force on the control cable 66.

Figure 6:
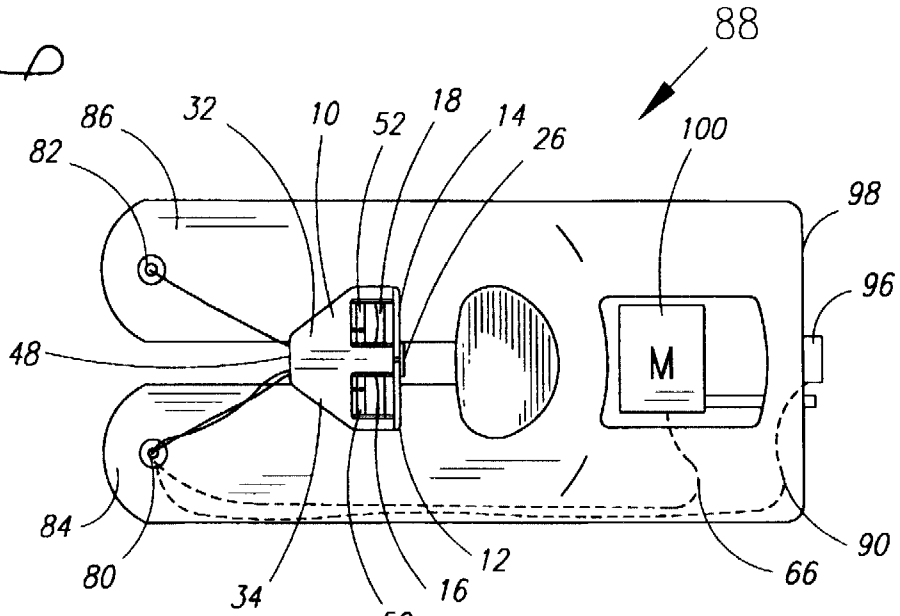
FIG. 6 is a top plan view of the ski rider and ski rider controls of FIG. 5, illustrating the connections within the ski rider to cables originating in the ski rider controls.
Figure 5:
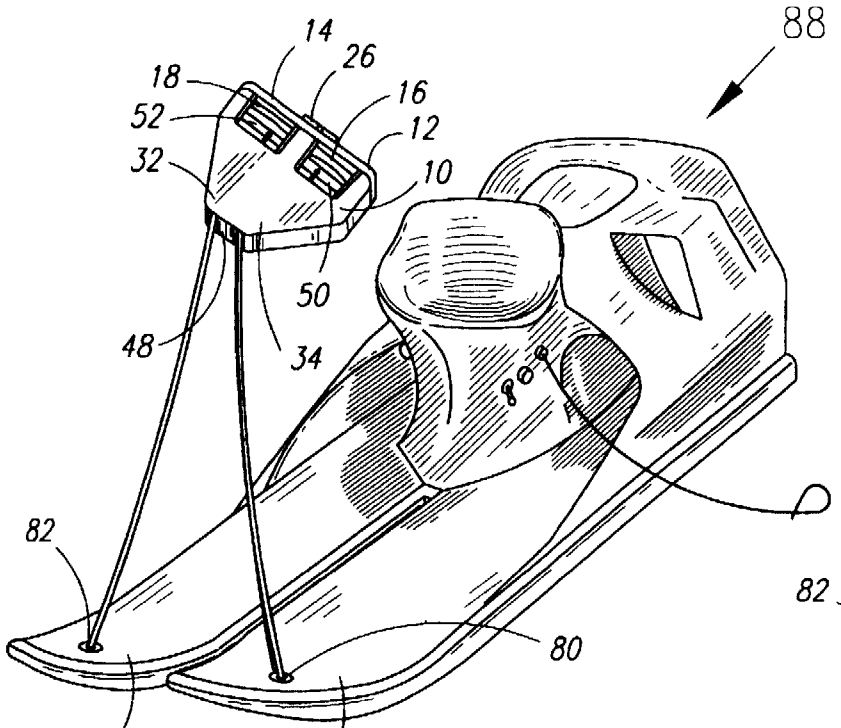
FIG. 5 is a perspective view of a ski rider with ski rider controls attached thereto.

Referring now also to FIGS. 5 and 6, the control cable 66 is held to an inside of the external casing 32 via a control cable bracket 67 and exits the external casing 32 via a first rope opening 68 provided in the external casing 32 at the front end 28. Two rope securing extensions 70 and 72 are provided within the external casing 32 so that a first rope securing extension 70 is provided adjacent the first rope opening 68 and a second extension 72 is provided adjacent a second rope opening 74 also provided in the external casing 32 at the rear end 48.

A first rope 76 adjustable secures on one end to the first rope securing extension 70 and an opposite end of the first rope 76 extends through the first rope opening 68. A second rope 78 also adjustable secures on one end to the second rope securing extension 72 and an opposite end of the second rope 78 extends through the second rope opening 74. The free ends of the first and second ropes 76 and 78 secure to front openings 80 and 82, provided respectively in forward extending legs 84 and 86 provided on a ski rider 88. In order to adjust the length of the ropes 76 and 78 for operators of different heights, a loop is formed in each rope 76 and 78 and these loops are placed around the rope securing extensions 70 and 72 in order to shorter the effective lengths thereof.

The thumb throttle 26 operative attaches to one end of a throttle control cable 90 so that a pulling or, alternately, a pushing force is exerted on the throttle control cable 90 whenever the thumb throttle 26 is pivoted by the operator. The throttle control cable 90 passes through a central opening 32 provided in the external casing 32 at the front end 28 of the ski rider control 10, passes through a throttle cable bracket 94 secured internally on the external casing 32, passes out of the external casing 32 along with the first rope 76 via the first rope opening 68, enters the ski rider 88 via the front opening 80 and operatively secures via an opposite end of the throttle control cable 90 to a water jet 96 pivotably provided at a rear end 98 of the ski rider 88. The water jet 96 is pivotable left and right by means of pulling or pushing forces exerted on the throttle control cable 90 in order to steer the ski rider 88.

Figure 2:
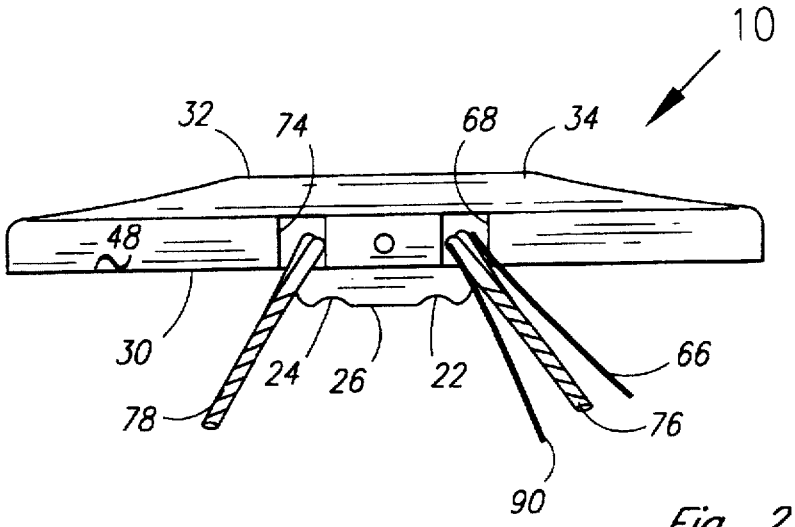
FIG. 2 is a rear elevation of the ski rider controls of FIG. 1.

Likewise, as shown in FIGS. 2, 4 and 6, the control cable 66 operatively secures via one end of the control cable 66 to the first end 60 of pivotable bar 58, extends through the control cable bracket 67, exits the external casing 32 along with the first rope and the throttle control cable 90 via the first rope opening 68, enters the ski rider 88 via the front opening 80 and operatively secures via an opposite end of the control cable 66 to a motor 100 provided in the ski rider 88 for powering the ski rider 88. The motor 100 is controlled in its operation by means of pulling or pushing forces exerted on the control cable 66 in order to accelerate or decelerate the ski rider 88.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. Ski rider controls for controlling speed and for steering a ski rider comprising an external casing, a pair of movable bars movably provided in said external casing and engagable by an operator's hands, a control cable operative connected on one end to a water jet pivotably provided on a ski rider and operatively connected on an opposite second end to said movable bars in order that movement of the movable bars causes a corresponding pivotal movement of the water jet, and a thumb throttle pivotably secured to said external casing, a throttle control cable operatively connected on one end to a motor provided in said ski rider and operatively connected on an opposite second end to said thumb throttle in order that movement of the thumb throttle causes the motor to accelerate and decelerate the ski rider.

2. Ski rider controls according to claim 1 further comprising a pivotal bar pivotally secured to said external casing at a central pivot point on said pivotal bar, said movably bars connected one on either end of said pivotal bar, and one end of a said pivotal bar connected to said second end of said control cable.

3. Ski rider controls according to claim 2 further comprising a companion bar provided in said external casing associated with each movable bar, each movable bar and its companion bar secured together in space apart arrangement with said companion bar provided rearward from its associated movable bar within said external casing, each movable bar and its associated bar slidably secured between a pair of parallel tracks, each said movable bar connected to said pivotal bar via its associated bar.

4. Ski rider controls according to claim 3 further comprising external bars secured on a front end of said external casing and associated with said movable bars so that an operator can place palms of his hands on said external bars and curl his fingers around said movable bars.

5. Ski rider controls according to claim 4 wherein said thumb throttle is provided adjacent said front end of said external casing so it can be engaged by thumbs of the operator's hands.

6. Ski rider controls according to claim 5 wherein said thumb throttle is provided with thumb indentations and each said movable bar is provided with finger grips.

7. Ski rider controls according to claim 1 further comprising said external casing flexibly secured to forward extending legs of said ski rider.

8. Ski rider controls according to claim 7 wherein said external casing is secured to said forward extending legs by means of ropes of adjustable lengths.

9. Ski rider controls according to claim 7 wherein one end of each said rope secures to a front opening in one of said forward extending legs and an opposite end of each said rope is a formed into a loop that secures around one of two rope securing extensions provided in said external casing.

* * * * *